United States Patent [19]

Solheim

[11] Patent Number: 4,512,577

[45] Date of Patent: Apr. 23, 1985

[54] SET OF GOLF CLUBS

[76] Inventor: Karsten Solheim, 501 Wakonda La., Phoenix, Ariz. 85023

[21] Appl. No.: 620,521

[22] Filed: Jun. 11, 1984

Related U.S. Application Data

[63] Continuation of Ser. No. 412,910, Aug. 30, 1982, abandoned.

[51] Int. Cl.[3] ..... A63B 53/04

[52] U.S. Cl. ..... 273/77 A; 273/167 A; 273/78

[58] Field of Search ..... 273/80.2, 77 A, 78, 273/80 B, 80.3, 80.4, 80.5, 80.6, 80.7, 80.8, 80.9, 80 R; D21/214, 215, 216, 217, 218, 219, 220

[56] References Cited

U.S. PATENT DOCUMENTS 1,927,083 9/1933 Davis ..... 273/77 A 3,191,936 6/1965 Guier ..... 273/80.2

*Primary Examiner*—George J. Marlo

*Attorney, Agent, or Firm*—Freilich, Hornbaker, Rosen & Fernandez

[57] ABSTRACT

In a set of correlated golf clubs, the heads are provided with a narrowed neck (36) connecting the main body (32) of the club head to the hosel (34). A midsection (46) of the neck has a cross section of maximum dimension less than the diameter of the hosel so that, when the main body of the club head twists under impact with a ball, the narrowed neck will function as a torsion bar with most of the torsion occurring in the midsection (46). In that manner, the twisting motion of the main body is uncoupled from the hosel and shaft.

1 Claim, 12 Drawing Figures

(PRICR ART)

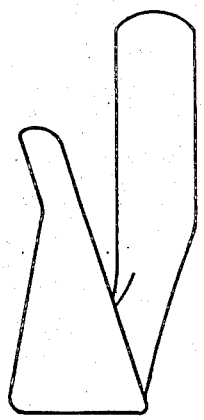
FIG. 7b
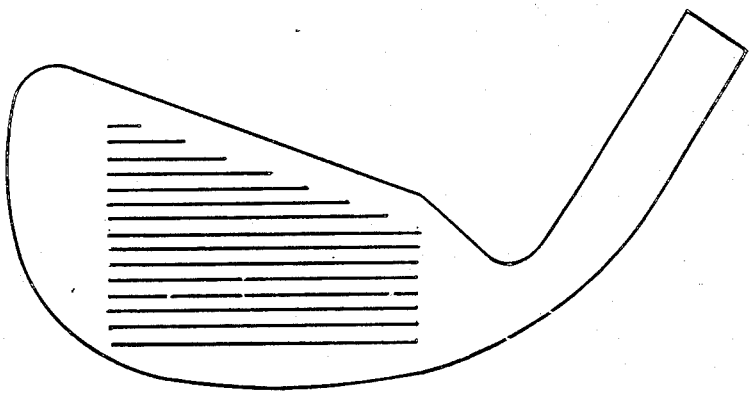
FIG. 7a
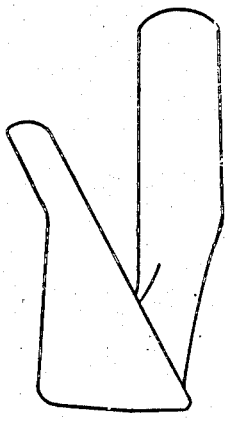
FIG. 8b
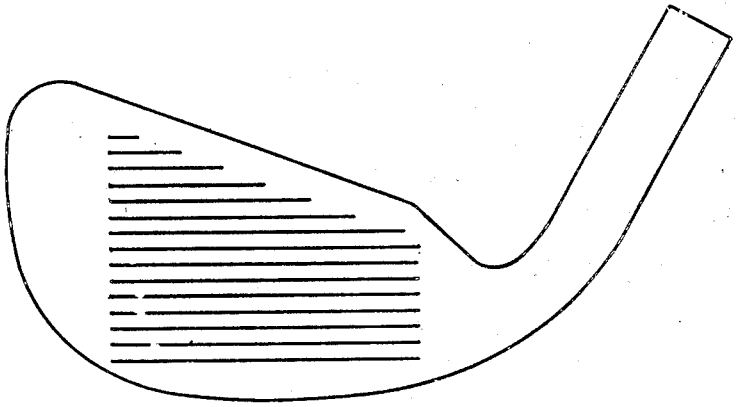
FIG. 8a
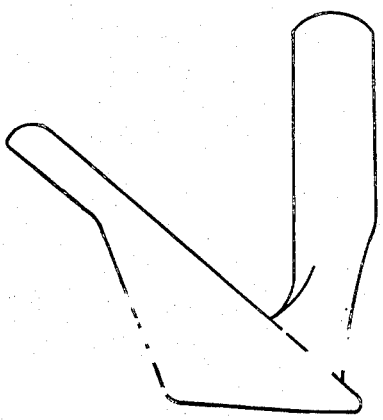
F.G. 9b
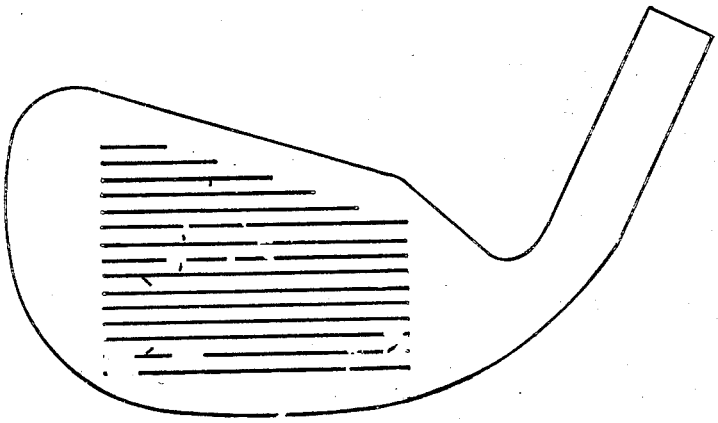
F.G. 9a

SET OF GOLF CLUBS

This application is a continuation of application Ser. No. 06/412,910, filed Aug. 30, 1982 now abandoned.

BACKGROUND OF THE INVENTION

This invention relates to golf clubs of the type having iron heads for use on tees and fairways, and more particularly to an improvement in the performance of the clubs of a set in response to an off-center impact with a golf ball.

It is now well understood that although the golfer controls the swing of a golf club head, at impact the club head behaves as though it were a free mass having a particular velocity. Most of the energy of this mass is imparted to the ball in about half a millisecond, after which the ball compressed against the club face springs clear of it as it resumes its spherical shape.

Ideally, the center of impact between the club head and the ball is below the center of gravity so that the club head will twist downward during impact. This twisting increases backspin on the ball normally produced due to the loft of the club head.

To better understand the backspin normally produced on the ball, the club head should be visualized as a wedge driven between the ground and the ball, rather than as a mallet as used to strike a ball in croquet or polo. During the time the ball is in contact with the club head, the ball will tend to slide up the face of the club and friction imparts backspin which is opposite to the rotation the ball would have if it were rolling away from the golfer on the ground. Consequently, by the time the ball springs free of the club face, significant backspin has been imparted to the ball.

This backspin is desired in order to stop the ball from rolling forward on the ground once it alights, particularly when the ball alights on the green. By designing the club head so that the center of impact will normally be below the center of gravity, the twisting action referred to above is produced. Such twisting action adds to the backspin normally produced. However, the twisting action sometimes results in a vibration of the club head that is transferred through the shaft to "sting" the golfer's hands. Worse yet, any vibration that is set up in the club head also interfers with the normal flexing of the end of the shaft during impact. That flexing is desired because as the ball springs free of the club face, the flexed shaft straightens out to impact extra force to the ball.

It would be desirable to uncouple the twisting action of the club head from the shaft. Then any vibrations of the club head will not affect the flexing of the shaft. The club head would be allowed to twist more freely for greater backspin control. This control of backspin may be achieved for each stroke by raising or lowering the center of impact on the club face as required.

SUMMARY OF THE INVENTION

In accordance with the invention, the head of an iron golf club is uncoupled from the club shaft by a narrow neck between the main body and a hosel which connects the main body to a shaft. The neck, which is narrower at its midsection than the hosel, and of course narrower than the main body will thus function as a torsion bar to absorb the force of any twisting motion of the club head, and thus has less effect on the flexing of the club shaft.

The novel features that are considered characteristic of this invention are set forth with particularity in the appended claims. The invention will best be understood from the following description when read in connection with the accompanying drawings.

BRIEF DESCRIPTION OF THE DRAWINGS

FIGS. 7*a* and 7*b* are front and end views of a No. 2 club head of a correlated set embodying the present invention.

FIGS. 8*a* and 8*b* are front and end views of a No. 5 club head of the same correlated set embodying the present invention.

FIGS. 9*a* and 9*b* are front and end views of a club head for a pitching wedge of the same correlated set embodying the present invention.

DESCRIPTION OF PREFERRED EMBODIMENTS

Figure 1:
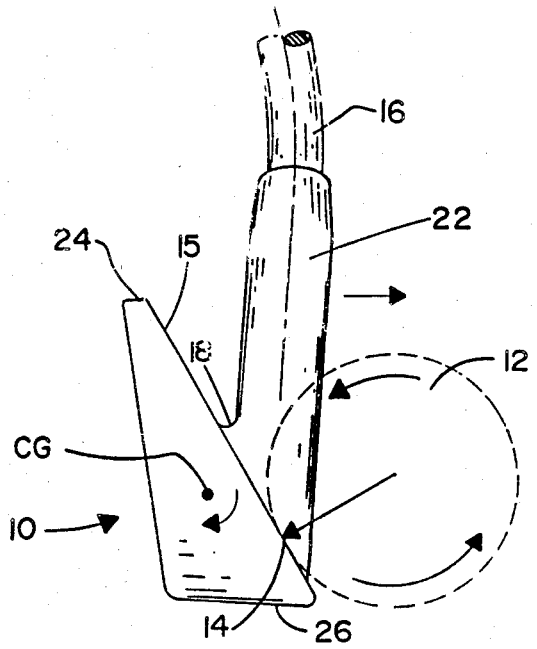
FIG. 1 is a schematic diagram which illustrates the twisting action of a conventional prior-art club head impacting a ball.
Figure 2:
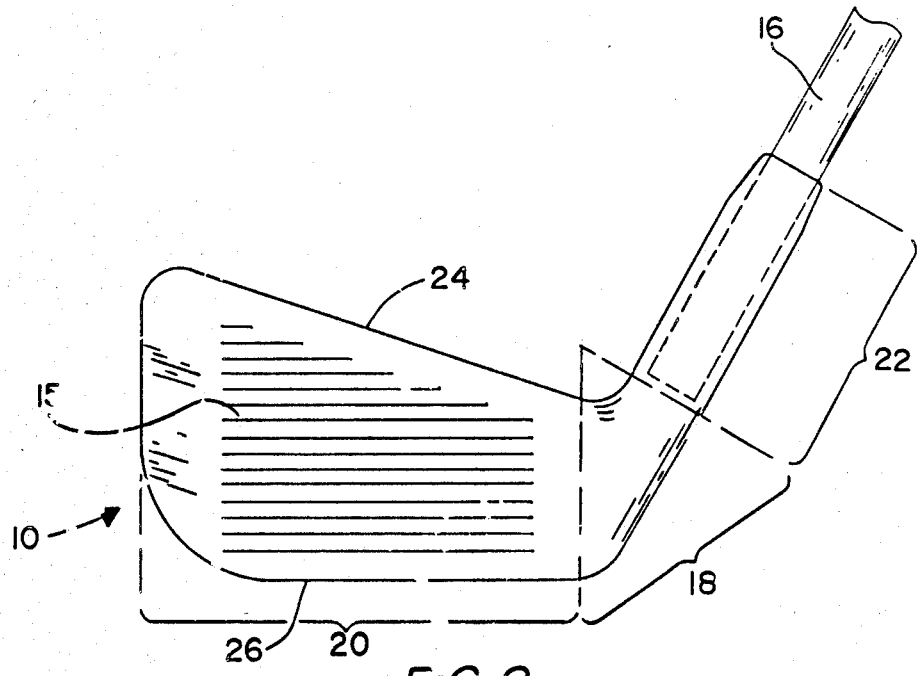
FIG. 2 (PRIOR ART)
FIG. 2 is a front view of the conventional prior-art club head shown in FIG. 1.

Referring now to FIGS. 1 and 2, there is shown a conventional club head 10 impacting a ball 12 with the center of impact between the club head and ball at a point 14 below the center of gravity, CG, of the club head. As the club head moves into the ball, the ball tends to slide up the sloping face 15 of the club head, but due to friction the ball will actually roll up, thus imparting backspin to the ball. Impact with the ball also produces a clockwise twisting motion of the club head about its center of gravity as indicated, which in turn imparts a counterclockwise rotation of the ball due to the gear effect between the club face and the ball surface. This twist of the club head thus increases the backspin otherwise being imparted to the ball.

The amount of twist produced in the club head is a function of how far the center of impact is below the center of gravity. This is a factor over which the golfer has control, and since controlled backspin is desired by the golfer, it is desirable to have the club head twist free of the club shaft 16.

As noted hereinbefore, the lower end of the club shaft will flex back during impact, as shown in FIG. 1, thus storing energy that is released as the ball leaves the club head and the flexed shaft springs forward. The ball will thus leave the club head not only with additional backspin due to the twisting action of the club head, but also with additional velocity.

Both of these effects are coupled in prior-art golf clubs (of the general configuration shown in FIG. 1) due to a thick neck 18 used to connect the main body 20 of the club head to a hosel 22, as illustrated more clearly in FIG. 2 which shows the club head 10 of FIG. 1 as viewed from the front. Its upper edge 24 and sole 26 of the club head extend to the neck 18 which curves up sharply to meet the hosel.

From the two views shown in FIGS. 1 and 2, it can be seen that the neck is purposely made very rigid. It can thus be appreciated that the main body 20 of the club head (sometimes referred to hereinafter as the "club head proper") is rigidly connected to the hosel 22 by a very rigid neck 18. Consequently, any twisting of the club head proper will pivot the hosel forward, thereby causing the shaft 16 to bend near the hosel.

In the case of impact with the ball below the center of gravity, the bending will be in the same direction as the flexing of the shaft, as illustrated in FIG. 1, but may nevertheless cause vibrations that will travel through the shaft to the golfer's hands. What can be worse is that twisting of the club head and flexing of the shaft may be impeded by the rigid neck 18 so that optimum backspin and velocity of the ball may not be achieved. In the case of impact with the ball above the center of gravity to produce forward or top spin of the ball, the club head will twist in the direction opposite that shown in FIG. 1, i.e., counterclockwise, to cause the hosel to pivot against the normal flexing of the shaft, in which case severe vibrations may be created in the club head and shaft. The present invention uncouples the club head proper from the hosel so that twisting of the club head proper will not affect the normal flexing of the shaft, and optimum spin (back or forward) maybe imparted to the ball.

Figure 3:
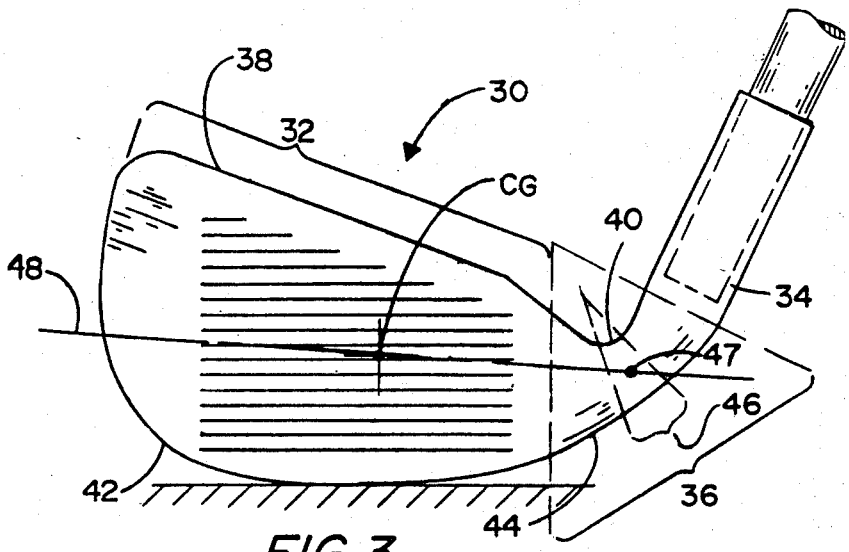
FIG. 3 is a front view of an iron club head embodying the present invention.
Figure 4:
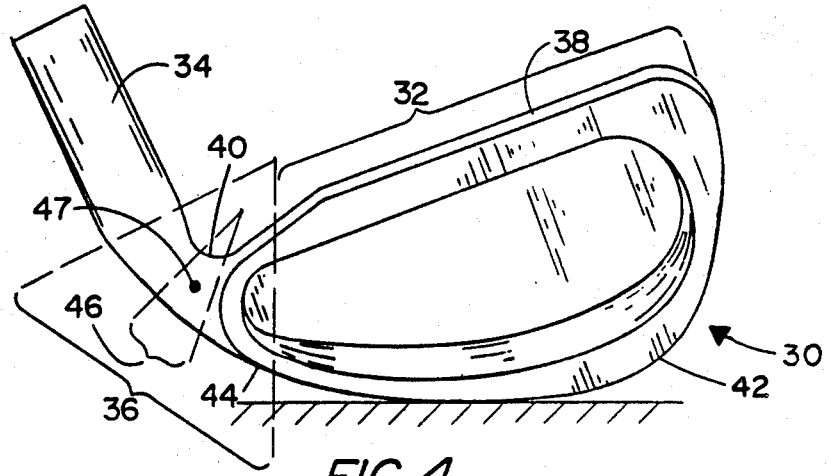
FIG. 4 is a rear view of the club head shown in FIG. 3.
Figure 5:
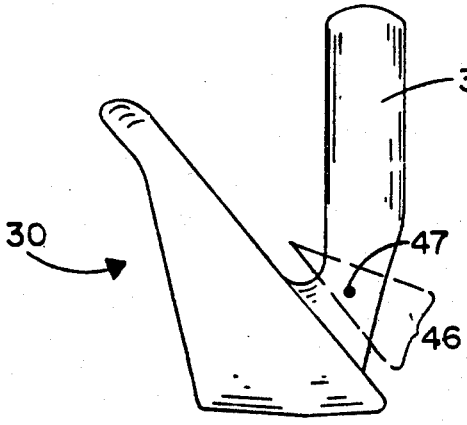
FIG. 5 is an end view of the club head shown in FIG. 3.

Referring now to FIGS. 3, 4 and 5, which illustrate a front, rear and end view of a head 30 for a No. 8 iron, a main body 32 is connected to a hosel 34 by a narrowed neck 36. An upper edge 38 extends through at least the scored portion of the club face and then slopes downward to merge with an upper curve 40 of the neck. A sole 42 extends through the length of the club head and merges with a lower curve 44 of the neck. The upper and lower curves are selected to define a neck that is narrowest in a midsection 46 thereof, i.e., a cross section of the neck in this midsection 46 will have a maximum dimension that is smaller than the diameter of the hosel 34. The neck 36 will thus function as a torsion bar, twisting about the center of this midsection 46 when the main body 32 of the head 30 is twisted in one direction and the hosel is not twisted, or is twisted in the opposite direction.

Figure 6:
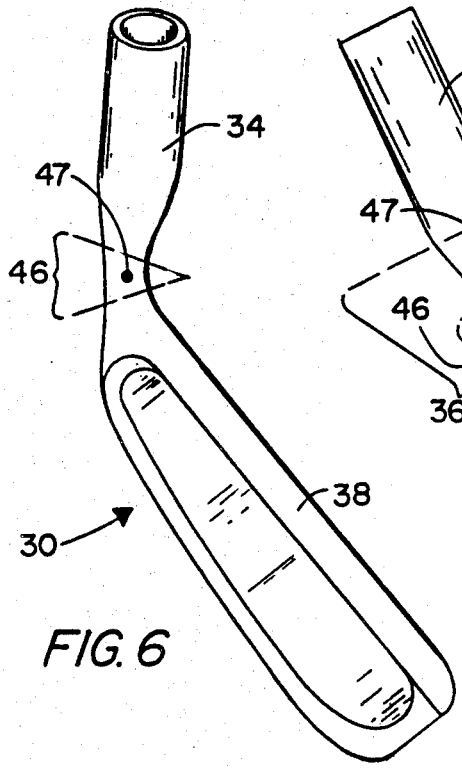
FIG. 6 is a top view of the club head shown in FIG. 3 with the face in a vertical plane.

This torsion occurs only under the tremendous force produced by the club head impacting a ball with very high velocity (about 100 mph). Because of this midsection 46 having a smaller cross section than the rest of the narrowed neck, the main body 32 of the club head will twist about an axis 48 passing through the center 47 of this midsection and the center of gravity, CG, of the club head 30. Thus, to achieve a torsion-bar effect that uncouples the twist of the main body 32 of the club head 30 from the hosel 34, the narrow neck 36 is made narrower at its midsection 40 such that its largest dimension is less than the diameter of the hosel, and its smallest dimension (seen in FIG. 6) is significantly less.

FIGS. *7a*, *8a* and *9a* illustrate No. 2, No. 5 and pitching wedge club heads of a correlated golf club set, each of which has been provided with a narrow neck as described with reference to FIGS. 3 through 6 for a No. 8 iron. FIGS. *7b*, *8b* and *9b* illustrate end views of the club heads of FIGS. *7a*, *8a* and *9a*, respectively.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. In a set of correlated iron-type golf clubs, the head of each club having a main body, a hosel for receiving a shaft, and a neck connecting said hosel to said main body, said main body having a face for striking a ball, a sole, a toe, and an upper edge inclined upwardly from said neck to said toe, an improvement comprised of a shape for said neck defined by a smooth convex curve, as viewed from the face, of approximately constant radius over a sector extending from said sole to said hosel, and a sharper concave curve of shorter radius extending up to said hosel over a smaller sector approximately centered on the sector of said smooth curve of greater radius to define a neck having at its mid-cross section a maximum dimension which is smaller than the diameter of said hosel at the lower end of said hosel where it connects to said neck, whereby said neck uncouples the twisting action of said club head from said shaft.

* * * * *